US012546104B2

(12) United States Patent
Williams

(10) Patent No.: US 12,546,104 B2
(45) Date of Patent: Feb. 10, 2026

(54) MODULAR BALCONY SYSTEM, COMPONENTS THEREOF AND METHOD OF ASSEMBLY AND INSTALLATION THEREOF

(71) Applicant: LES ENTREPRISES LUC WILLIAMS INC., Ogden (CA)

(72) Inventor: Luc Williams, Ogden (CA)

( * ) Notice: Subject to any disclaimer, the term of this patent is extended or adjusted under 35 U.S.C. 154(b) by 190 days.

(21) Appl. No.: 18/325,885

(22) Filed: May 30, 2023

(65) Prior Publication Data

US 2024/0035269 A1 Feb. 1, 2024

Related U.S. Application Data

(60) Provisional application No. 63/491,406, filed on Mar. 21, 2023, provisional application No. 63/365,495, filed on May 30, 2022.

(51) Int. Cl.
*E04B 1/00* (2006.01)
*E04F 15/02* (2006.01)
*E04F 15/06* (2006.01)

(52) U.S. Cl.
CPC ..... *E04B 1/003* (2013.01); *E04F 15/02044* (2013.01); *E04F 2015/0205* (2013.01); *E04F 15/06* (2013.01)

(58) Field of Classification Search
CPC ..... E04B 1/003; H02S 20/24; H02S 20/23; H02S 20/22; H02S 30/10; E04F 15/02044; E04F 2015/0205; E04F 15/06; E04F 15/02183; E04F 15/0247; E04F 15/02464; E04F 15/02458; E04D 13/0477
See application file for complete search history.

(56) References Cited

U.S. PATENT DOCUMENTS 5,483,773 A * 1/1996 Parisien ..... E04B 1/003 52/656.1
10,526,796 B1 * 1/2020 Way ..... B63B 35/34
2006/0162262 A1 * 7/2006 Smith ..... E04B 1/34342 52/58
2011/0203215 A1 * 8/2011 McNamee ..... E04B 5/10 256/65.01

(Continued)

FOREIGN PATENT DOCUMENTS

DE 4206005 A1 * 9/1993 ..... E04B 1/003
DE 29903639 U1 * 6/1999 ..... E04B 1/003

(Continued)

*Primary Examiner* — Theodore V Adamos

(74) *Attorney, Agent, or Firm* — Brouillette Legal Inc.; Robert Brouillette

(57) ABSTRACT

Provided is a modular balcony system configured to be assembled with sliding mating parts and to guide fluid away from a surface area under the system. The modular balcony system comprises main beams having a gutter for guiding fluid away from the surface area. Along the length of the main beams are secondary beams supporting a floor and a soffit. Each of the main beams, secondary beams and soffit are secured to one another by sliding mating parts in notches. The soffit comprises an elevated surface for securing to the secondary beams and a low surface for guiding fluid towards the gutter of the main beams. A method of assembling and installing a modular balcony system is also provided.

14 Claims, 23 Drawing Sheets

(56) References Cited

U.S. PATENT DOCUMENTS

| | | | | |
|---|---|---|---|---|
| 2011/0214369 | A1* | 9/2011 | Weber | E04B 1/003<br>52/832 |
| 2011/0302857 | A1* | 12/2011 | McClellan | F24S 40/44<br>52/173.3 |
| 2024/0026675 | A1* | 1/2024 | Weber | E04B 5/14 |

FOREIGN PATENT DOCUMENTS

| | | | | |
|---|---|---|---|---|
| DE | 29903648 | U1 * | 6/1999 | E04B 1/003 |
| DE | 19921837 | A1 * | 9/2000 | E04B 1/003 |
| DE | 10200527 | A1 * | 7/2003 | E04B 1/003 |
| DE | 202020103926 | U1 * | 11/2021 | |
| EP | 3282066 | A1 * | 2/2018 | E04F 15/02044 |
| WO | WO-2015070342 | A1 * | 5/2015 | E04B 1/19 |
| WO | WO-2022112741 | A1 * | 6/2022 | E04B 1/003 |

* cited by examiner

MODULAR BALCONY SYSTEM, COMPONENTS THEREOF AND METHOD OF ASSEMBLY AND INSTALLATION THEREOF

CROSS-REFERENCE TO RELATED APPLICATIONS

The present patent application claims the benefits of priority of U.S. Provisional Patent Application No. 63/365,495 entitled "MODULAR BALCONY SYSTEM AND METHOD OF ASSEMBLY THEREOF", and filed at the USPTO on May 30, 2022, and of U.S. Provisional Patent Application No. 63/491,406 entitled "MODULAR BALCONY SYSTEM AND METHOD OF INSTALLING THE SAME", and filed at the USPTO on Mar. 21, 2023, the content of which are incorporated herein by reference.

FIELD OF THE INVENTION

The present invention generally relates to the field of balconies and methods of assembly and installation thereof. The present invention more specifically relates to modular balcony systems and method of assembly and installation thereof.

BACKGROUND OF THE INVENTION

Conventional balconies generally require specialized or at least experienced personnel to assemble. Before assembling a balcony, the measurements for a given balcony must be determined in advance in order to plan the required materials. Furthermore, if any modifications to the balcony are needed during assembly, it may be complex to change the already established assembly plans. The most commonly used materials for building balconies are steel or wood. Understandably, these materials are limited with regards to the profiles they may be manufactured with, thus often requesting on the spot modifications during assembly which may further threaten the structural integrity of the balcony.

While components made of wood generally offer a great strength, such components are vulnerable to expansion or shrinking and to rotting which may cause fluid infiltration within and under the balcony. On the other hand, components made of steel may be heavy for an elevated structure and may rust. Thus, components made of steel may not be adequate when creating complex profiles during manufacturing and create maintenance cares.

Conventional balcony structures are thus prone to fluid infiltration, specifically water, under the surface area covered by the balcony. It may be undesirable for multiple reasons, such as if objects are stored under the balcony.

There is thus a need for a modular balcony system and a method of installation thereof allowing fast and easy assembly without the need of heavy or specialized tooling and allowing fluid to be guided away from the surface area covered by the balcony.

SUMMARY OF THE INVENTION

The shortcomings of the prior art are generally mitigated by providing a prefabricated and quick to install modular balcony with reduced or no need to cut any components, drill holes or use screws.

An aspect of the invention is a modular balcony system configured to be assembled with sliding mating parts and to guide fluid away from a surface area as described hereinabove.

Another aspect of the invention is a method of assembling a modular balcony system as described hereinabove Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE INVENTION

A novel modular balcony system and method will be described hereinafter. Although the invention is described in terms of specific illustrative embodiments, it is to be understood that the embodiments described herein are by way of example only and that the scope of the invention is not intended to be limited thereby.

Figure 1:
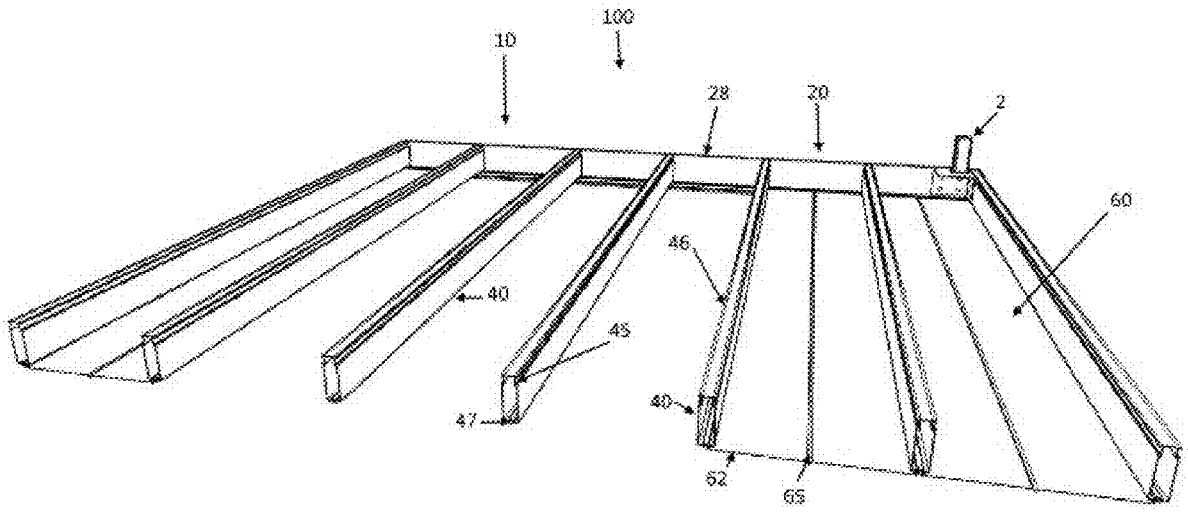
FIG. 1 is a top perspective view of an embodiment of a modular balcony system in accordance with the principles of the present invention.

Referring to FIG. 1, an embodiment of a modular balcony system 100, also referred to as modular system or balcony system or balcony, is shown. The modular balcony system 100 is configured to be easily assembled without the need of heavy or specialized tooling. More precisely, the embodied system 100 is a balcony structure that is modular. Understandably, the modular system 100 may be used in other types of structures than balconies, such as decks, stages, ramps, roof sections or floor sections. Therefore, when used herein, the word 'balcony' includes such similar structures.

The balcony 100 comprises structural and architectural elements. The structural elements, and thus the balcony, may be supported by any supporting means known in the art, such as fastening means, beams, etc. For example, columns, not shown, may be supporting the balcony from below. In yet other embodiments, the supporting means may be secured to the side of the system. In further embodiments, the supporting means may be a hanging system, not shown. The hanging system may be for example chains, steel cable or rods secured to a wall on one end and to the balcony on the other end. Secured to the structural elements may further be various external elements, such as guardrails columns 2.

A balcony 100 may comprise a plurality of sections 10, each of the sections 10 possibly comprising its own configuration of structural and architectural elements. A section 10 may cover a surface area of predetermined measurements which may be similar or different from the predetermined measurements of another of the sections 10. As such, a balcony system 100 having an unconventional available surface area to be built, for example a surface area that is not a square or a rectangle, may comprise a plurality of sections 10 secured to one another. Furthermore, the surface area of an existing balcony system 100 may be increased by adding new sections 10 to the system or reduced by removing installed sections 10. Any fastening means known in the art to join two sections 10 together may be used.

Figure 2:
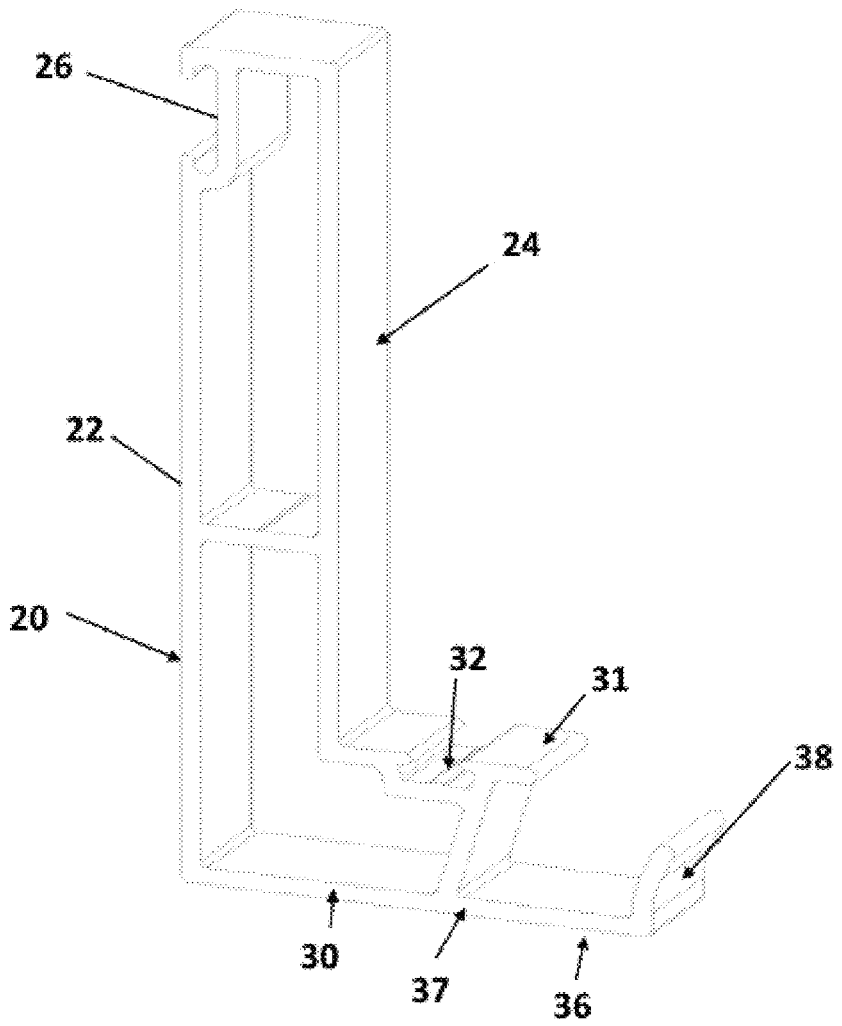
FIG. 2 is a perspective view of a main beam of a modular balcony system in accordance with the principles of the present invention.
Figure 3:
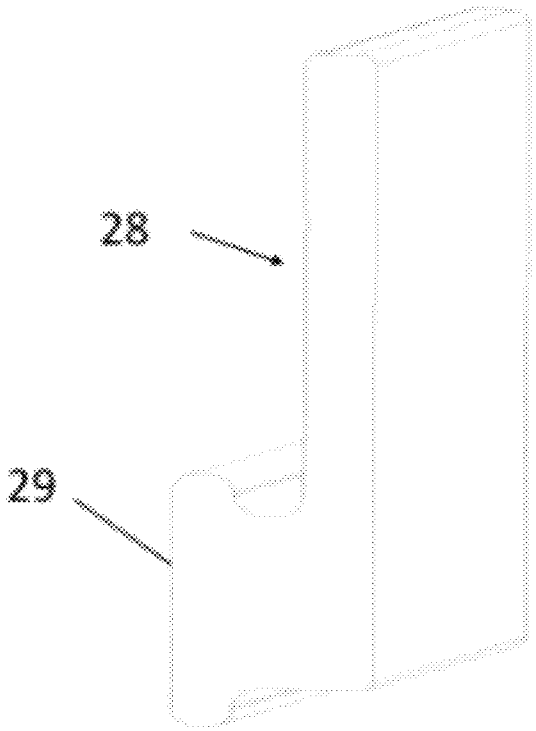
FIG. 3 is a perspective view of a contour fascia of a modular balcony system in accordance with the principles of the present invention.
Figure 4:
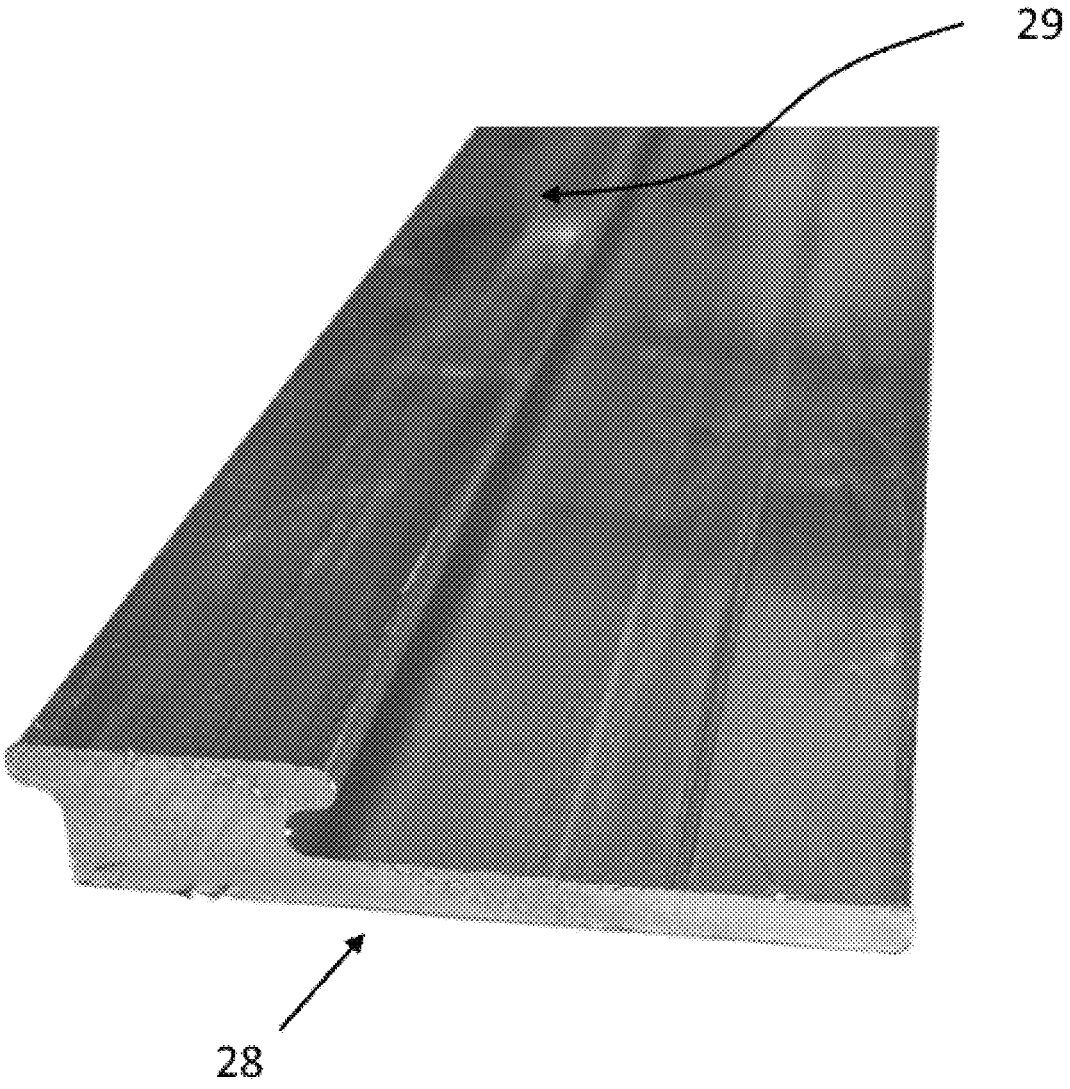
FIG. 4 is a perspective view of another contour fascia of a modular balcony system in accordance with the principles of the present invention.

Comprised with the structural elements are main beams 20. The main beams 20 are generally located along the entire periphery or part of the periphery of a section 10 of the balcony system 100. In other embodiments, main beams 20 may be located inside the surface area of a section 10. A detailed view of a main beam 20 is shown in FIG. 2. The main beam 20 comprises a first surface 22 and a second surface 24. The first 22 and second 24 surfaces are substantially opposite to one another.

The first surface 22 generally faces away from the section 10 to which the main beam 20 is part of whereas the second surface 24 generally faces towards the surface area of the section 10. On the first surface 22 may be found a first notch 26. The first notch 26 is configured to receive a mating piece, not shown. The mating piece may be secured to the first notch 26 by sliding sideways through said notch. The notch 26 may be located anywhere on the first surface 22, may cover part or the full length of the main beam 20 and may have any angle relative to the horizontal axis. The mating piece may be any architectural or structural mating piece known in the art. For example, as shown in FIGS. 1, 3, 4 and 11, the mating piece may be a contour fascia 28 configured to cover and protect the top corner of the main beam 20 and thus of the section 10 and/or balcony. The contour fascia 28 may comprise a mating section 29 for securing to the notch 26. The shape of the mating section 29 is configured to be received by and slide within the first notch 26. In yet another embodiment, the mating piece may be a fastening means for securing the main beam 20 of a first section 10 to another main beam of a second section 10.

Figure 5:
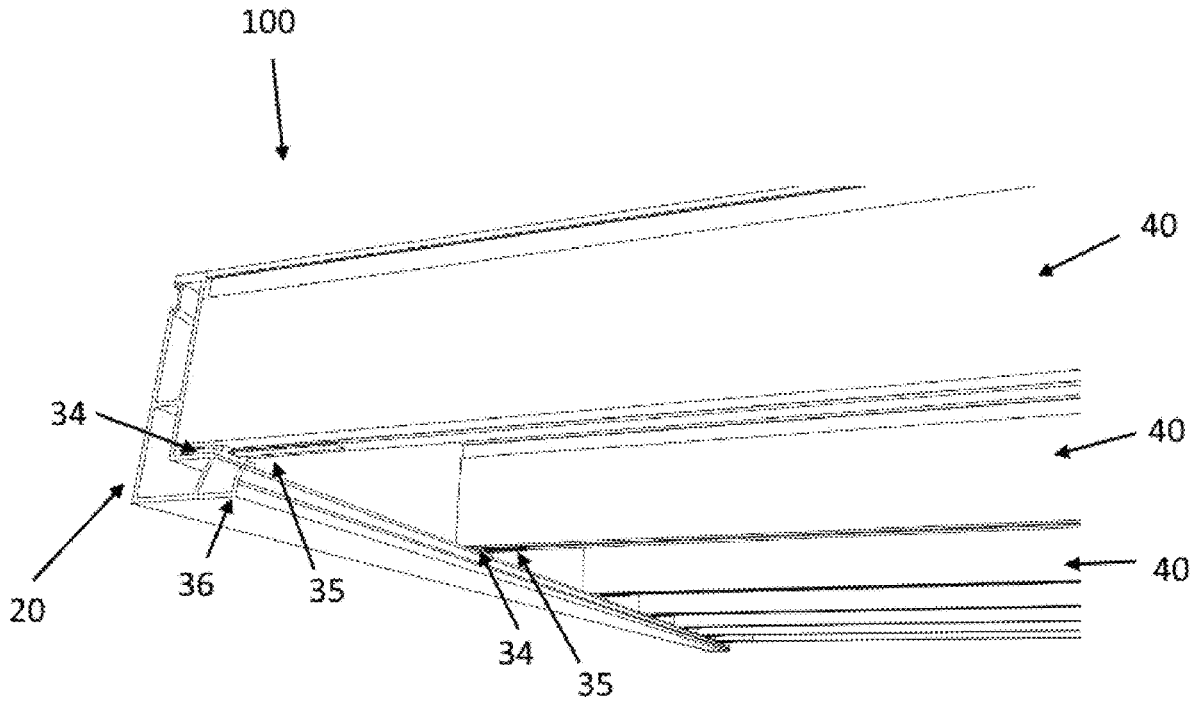
FIG. 5 is a side perspective view of an embodiment of a modular balcony system in accordance with the principles of the present invention.

Referring back to FIG. 2, the second surface 24 may be substantially flat. The main beam 20 may comprise at its bottom extremity a substantially horizontal section 30 comprising a top third surface 31. The third surface 31 may comprise a second notch 32 configured to receive a mating part or a combination thereof. The notch 32 may be located anywhere on the third surface 31, may cover part or the full length of the main beam 20 and may have any angle relative to the horizontal axis. The mating part may be any architectural or structural mating part known in the art. Referring to FIG. 5, the mating part 34 may be a part or a combination of parts having a mating sliding section in a first direction and another mating sliding section in a substantially perpendicular direction. This mating part 34 or combination of mating parts may allow for the main beam 20 to be secured to other elements of the balcony 100 running substantially perpendicularly to said main beam 20.

Referring now to FIGS. 1, 2 and 5, at the bottom 30 of the main beam 20 on the side of the second surface 24 may be a gutter 36. The gutter 36 may cover part or the entirety of the length of the main beam 20. The gutter 36 may comprise a vertical bottom surface 37 and a substantially vertical surface 38 forming a guiding path for guiding fluid following the length of the main beam 20. In the embodiment shown, the substantially vertical surface 38 is curved to improve retrieval of fluids, however said substantially vertical surface 38 may comprise any other shape known in the art of gutters.

Figure 6:
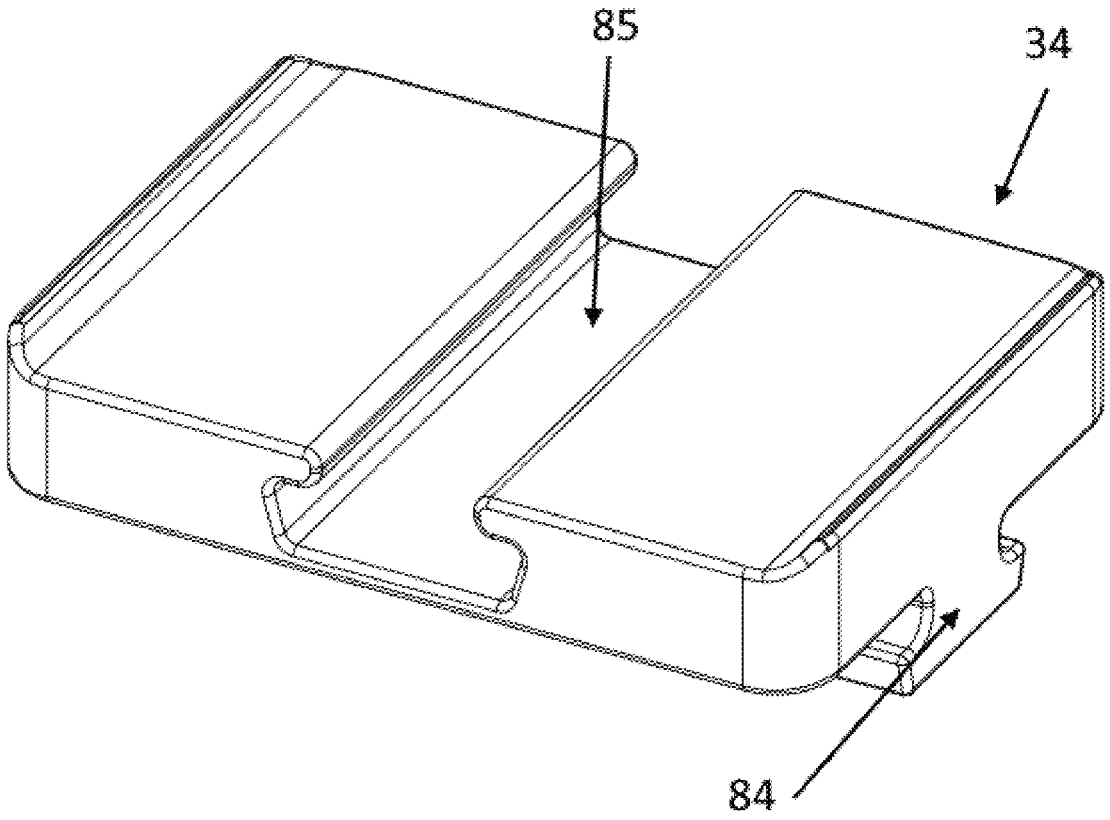
FIG. 6 is a perspective view of a mating part of a modular balcony system in accordance with the principles of the present invention.
Figure 7:
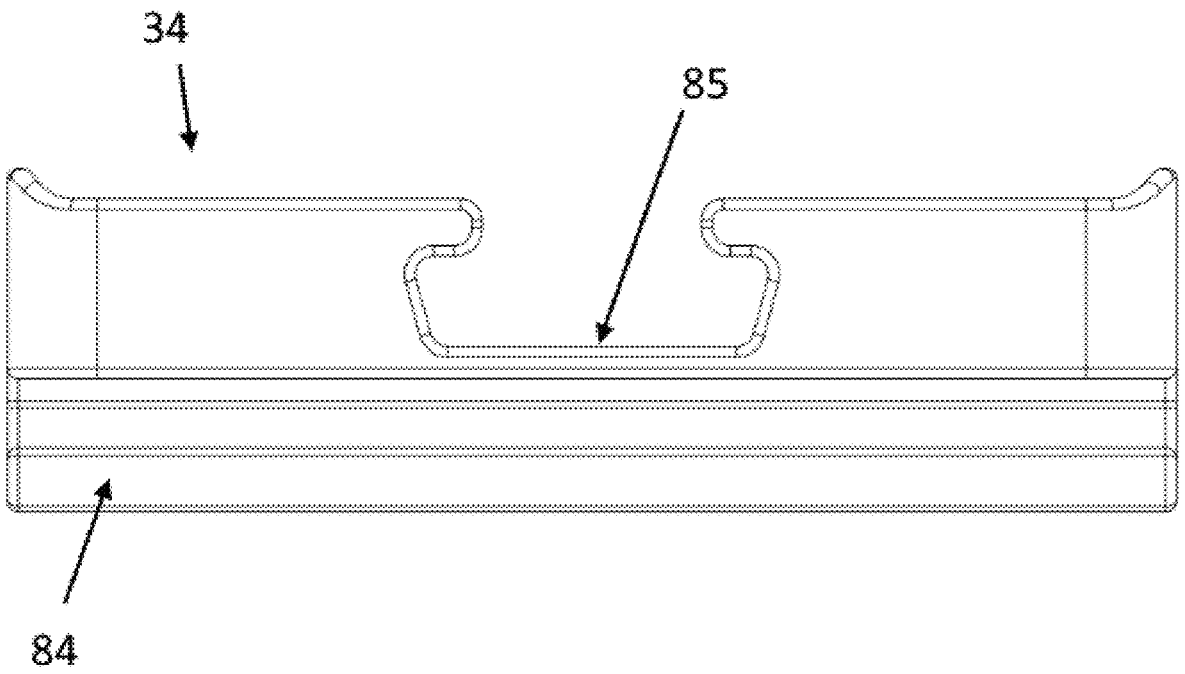
FIG. 7 is a front elevation view of the mating part of FIG. 6.
Figure 8:
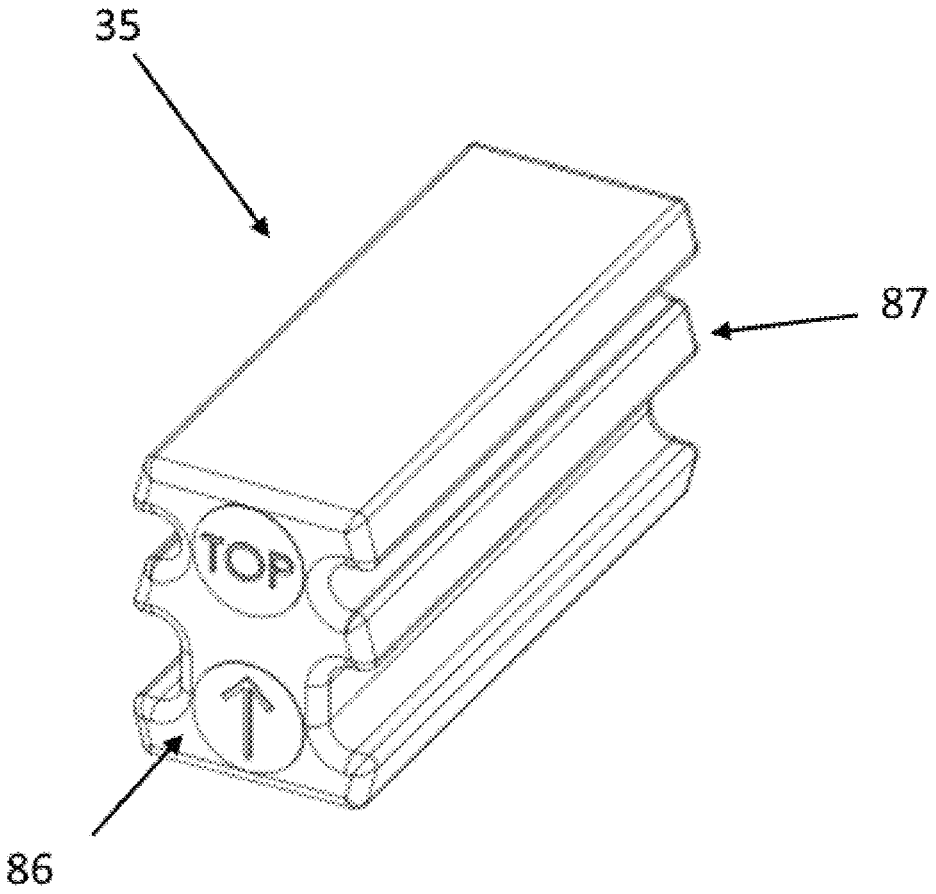
FIG. 8 is a perspective view of another mating part of a modular balcony system in accordance with the principles of the present invention.
Figure 9:
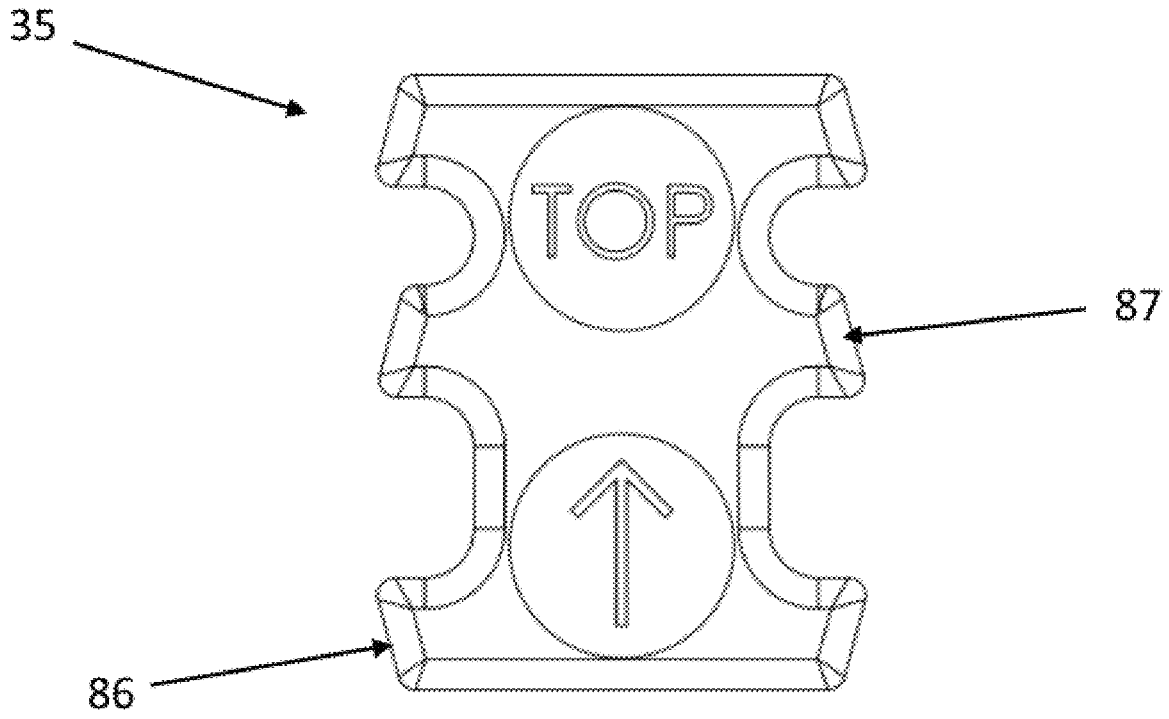
FIG. 9 is a front elevation view of the mating part of FIG. 8.
Figure 10:
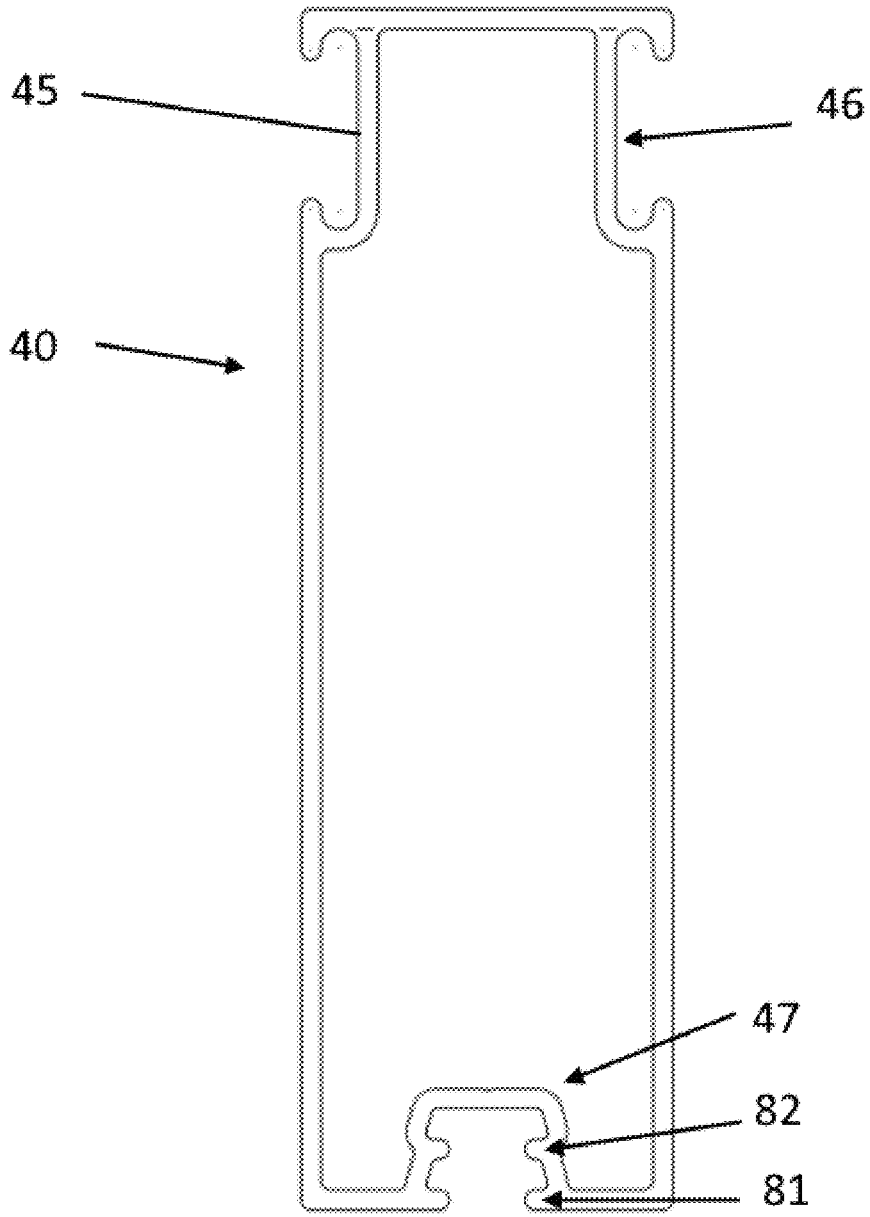
FIG. 10 is a front elevation view of a secondary beam of a modular balcony system in accordance with the principles of the present invention.

Secured to the main beam 20 by the mating part 34 or combination of mating parts 34, 35 slid in the second notch 32 may be a secondary beam 40 as shown in FIGS. 5 and 10. The secondary beam 40 is configured to be secured substantially perpendicular to the main beam 20 on the horizontal plan. Referring to FIGS. 6 and 7, the mating part 34 is adapted to slide in the second notch 32 of the main beam 20 and to either receive another mating part or the secondary beam 40. The shown mating part 34 is adapted to receive yet another mating part. Accordingly, the mating part 34 comprises a section 84 for sliding within the second notch 32 and a notch 85 for receiving a second mating part. Understandably, the shape and fastening means to the second notch 32 or to other mating parts may vary and are not limited to the shown embodiment. Referring now to FIGS. 8 and 9, a second mating part 35 is shown. The second mating part 35 is adapted to mate with the first mating part 34 and the secondary beam 40. The second mating part 35 therefore comprises a section 86 for mating with the notch 85 of the first mating part 34 and another section 87 for mating with the secondary beam 40. Understandably, the shape of the second mating part 35 may vary for mating with other parts and is not limited to the embodiment shown. It may further be understood that in other embodiments, the first and second mating parts 34, 35 may be manufactured unitarily. In yet other embodiments, there may be other mating parts.

Figure 11:
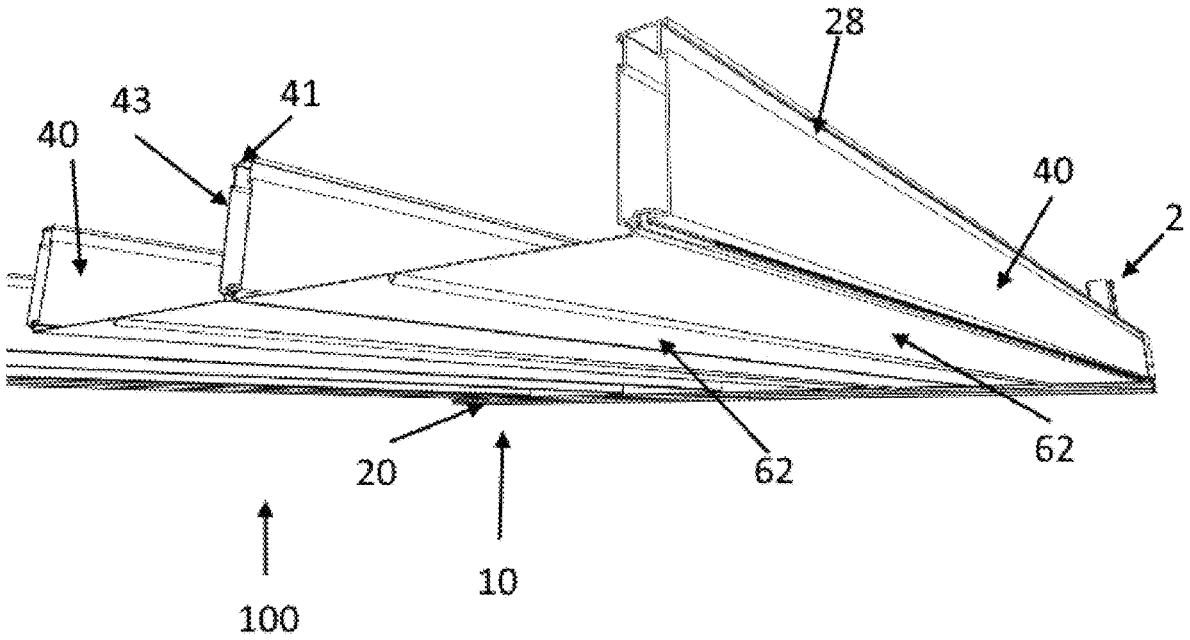
FIG. 11 is a bottom perspective view of an embodiment of a modular balcony system in accordance with the principles of the present invention.

As seen in FIGS. 1 and 11, a plurality of secondary beams 40 may be spaced apart from one another along the length of a main beam 20. Understandably, any appropriate distance between each of the secondary beams 40 may be used depending on the load to be supported. For example, the secondary beams 40 may be distanced from one another at 12 inches or 16 inches. A spacing part, not shown, having a predetermined length may be positioned between the secondary beams 40 during installation to obtain the desired distance. The spacing part may either be fixedly installed between the secondary beams 40 or may be removably installed during installation of the balcony 100 for discarding or reusing once the installation is complete. The secondary beams 40 are substantially elongated rectangular parts having a top 41, bottom 42 and side 43, 44 surfaces. Different embodiments may comprise varying quantities of surfaces and may be shaped differently. The secondary beams 40 are configured to support a floor surface, not shown, on top of them and a soffit 50 under them. Accordingly, the secondary beam 40 comprises a notch 45, 46 on each of the side surfaces 43, 44 and a notch 47 on the bottom surface 42 for securing to mating parts 34. The notches 45, 46, 47 may each be located anywhere on their respective surfaces. The notches 45, 46, 47 may further cover part or the entire length of the secondary beam 40. Referring to FIG. 10, the notch 47 may comprise two levels 81, 82. The shape of the notch 47 is adapted to receive the mating part 35 for securing to the main beam 20.

Figure 14:
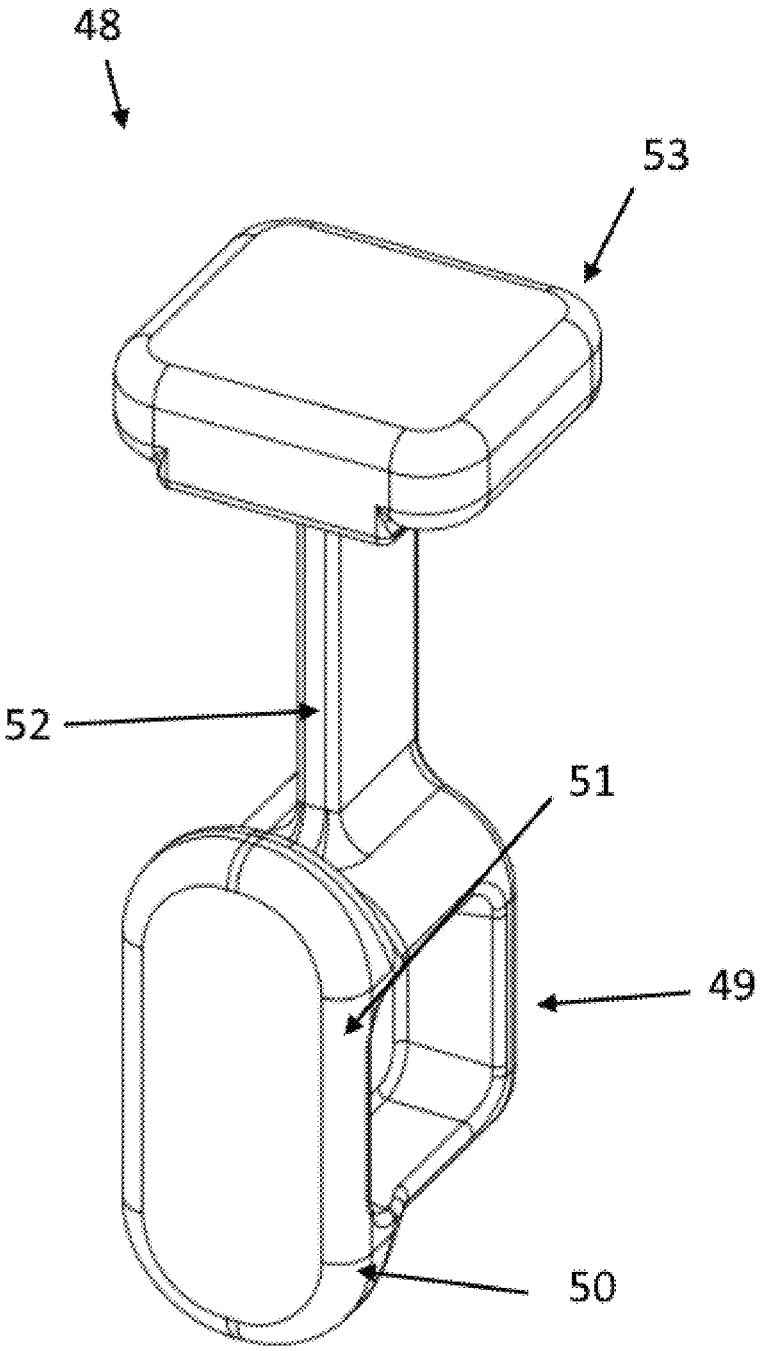
FIG. 14 is a perspective view of a support tab of a modular balcony system in accordance with the principles of the present invention.
Figure 15:
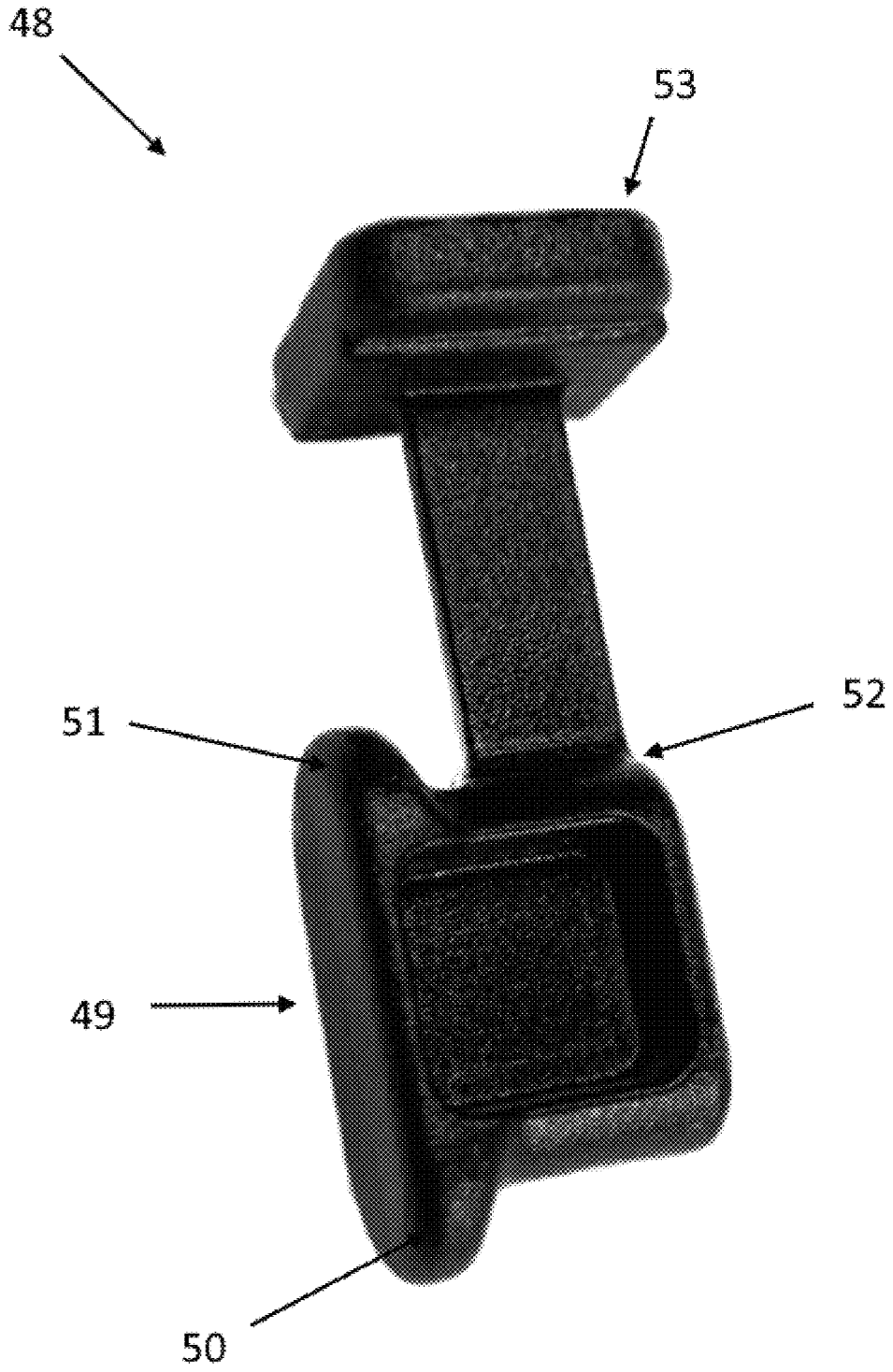
FIG. 15 is a perspective view of another support tab of a modular balcony system in accordance with the principles of the present invention.
Figure 16:
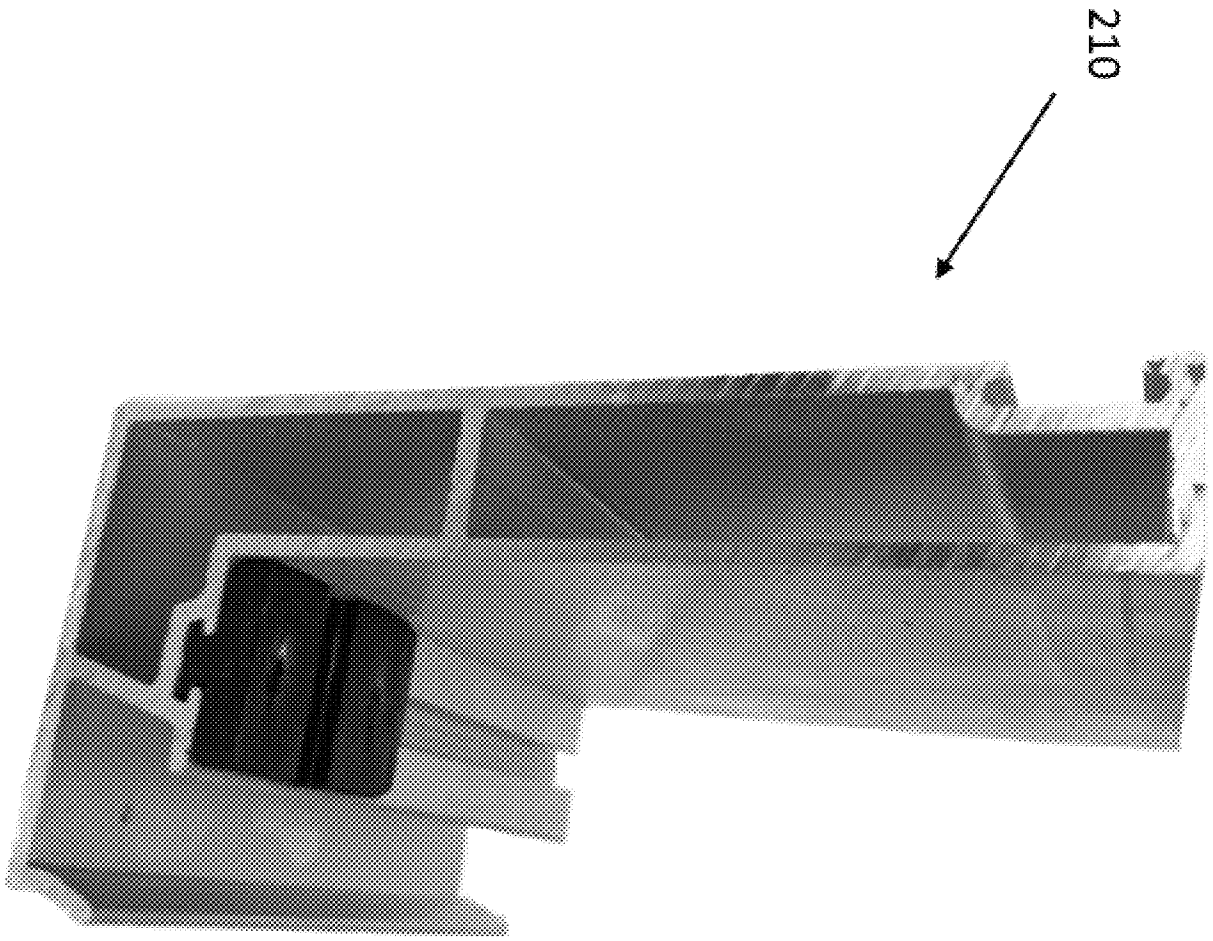
FIG. 16 is showing a method step of installing a first mating part to a primary beam of a modular balcony system in accordance with the principles of the present invention.
Figure 17:
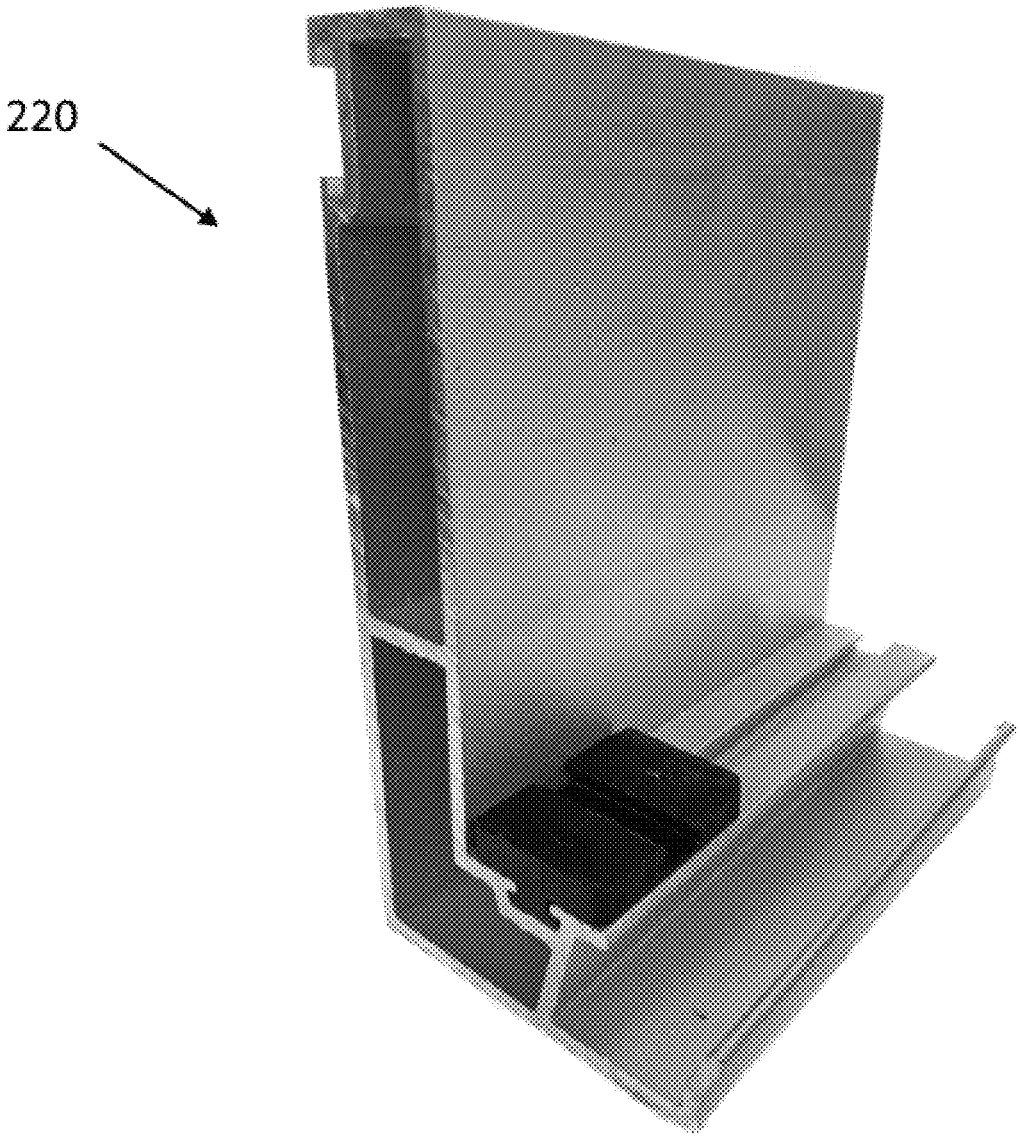
FIG. 17 is showing a method step of installing a second mating part to a first mating part of a modular balcony system in accordance with the principles of the present invention.
Figure 18:
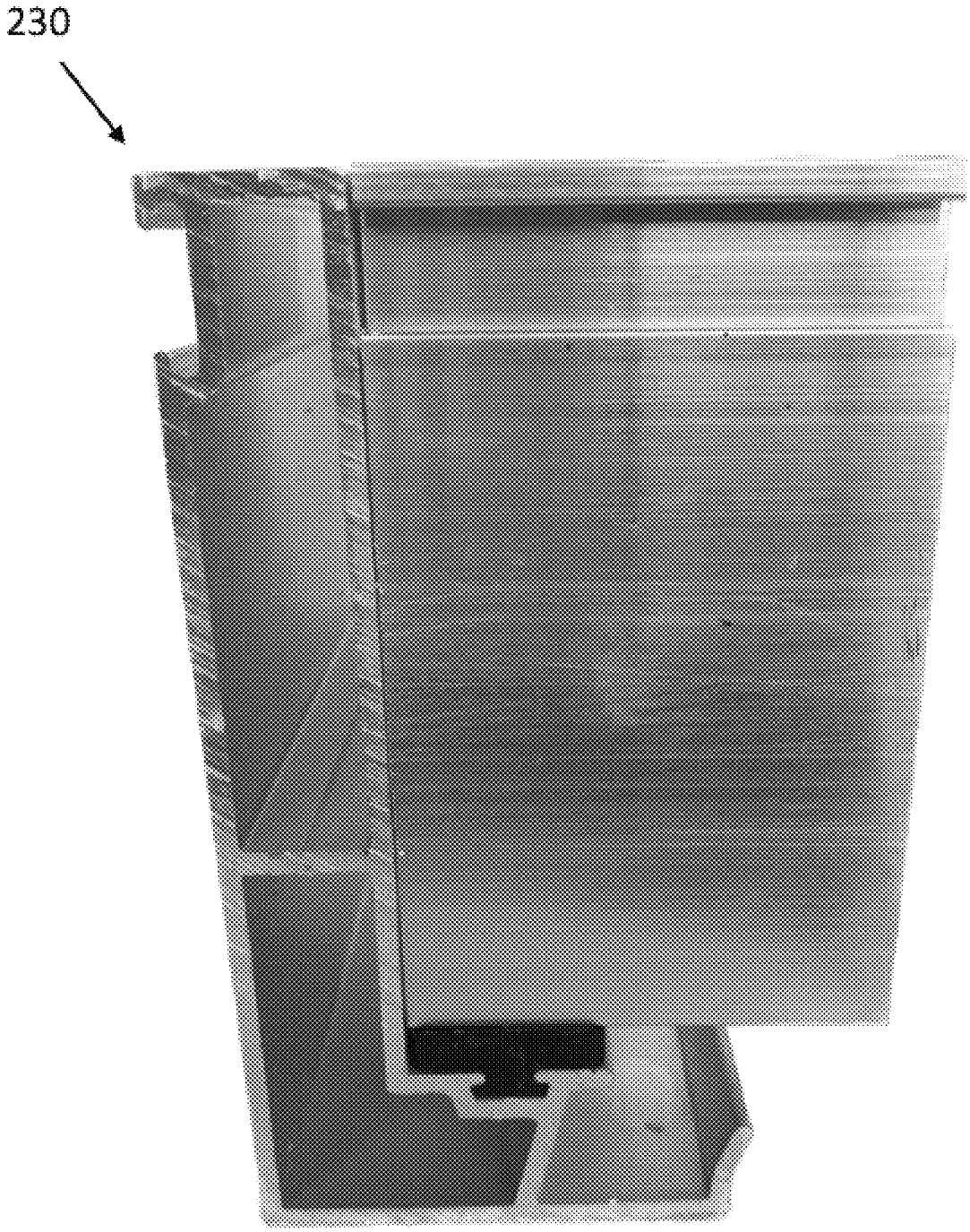
FIG. 18 is showing a method step of installing a secondary beam to a second mating part of a modular balcony system in accordance with the principles of the present invention.
Figure 19:
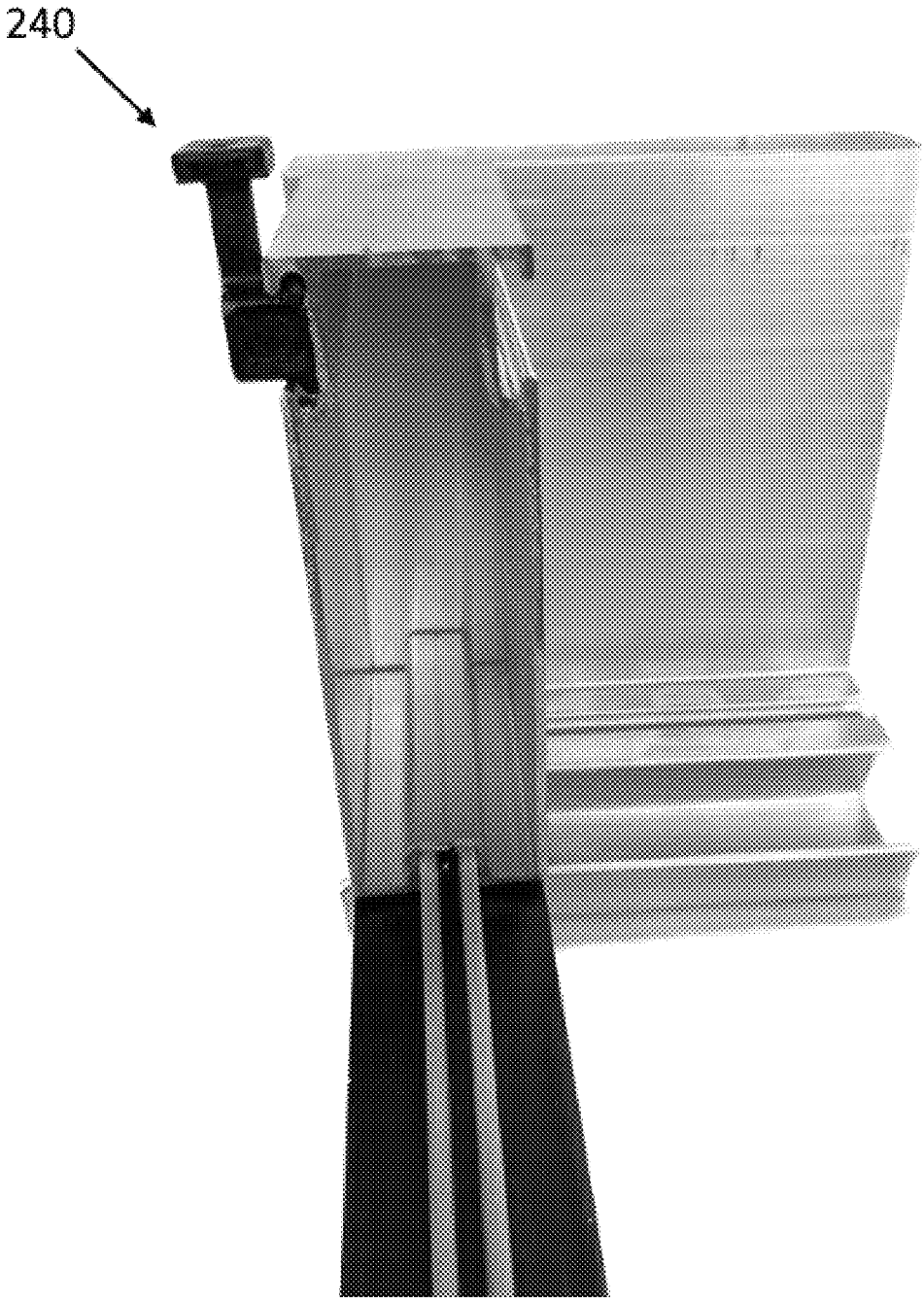
FIG. 19 is showing a method step of installing a first pair of dents of a mating band to a secondary beam of a modular balcony system in accordance with the principles of the present invention.
Figure 20:
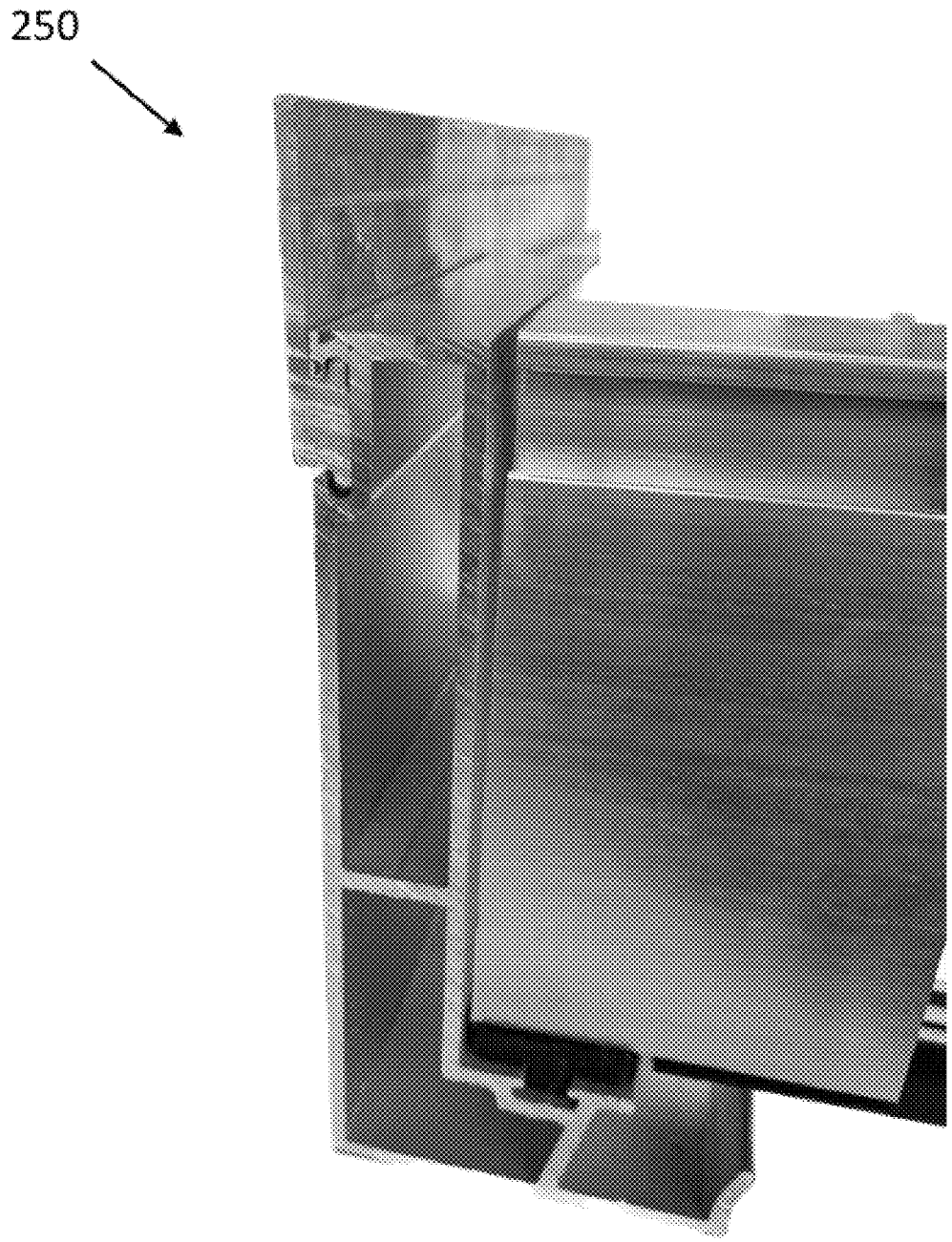
FIG. 20 is showing a method step of installing an elevated surface of a soffit to a secondary beam and a mating band of a modular balcony system in accordance with the principles of the present invention.
Figure 21:
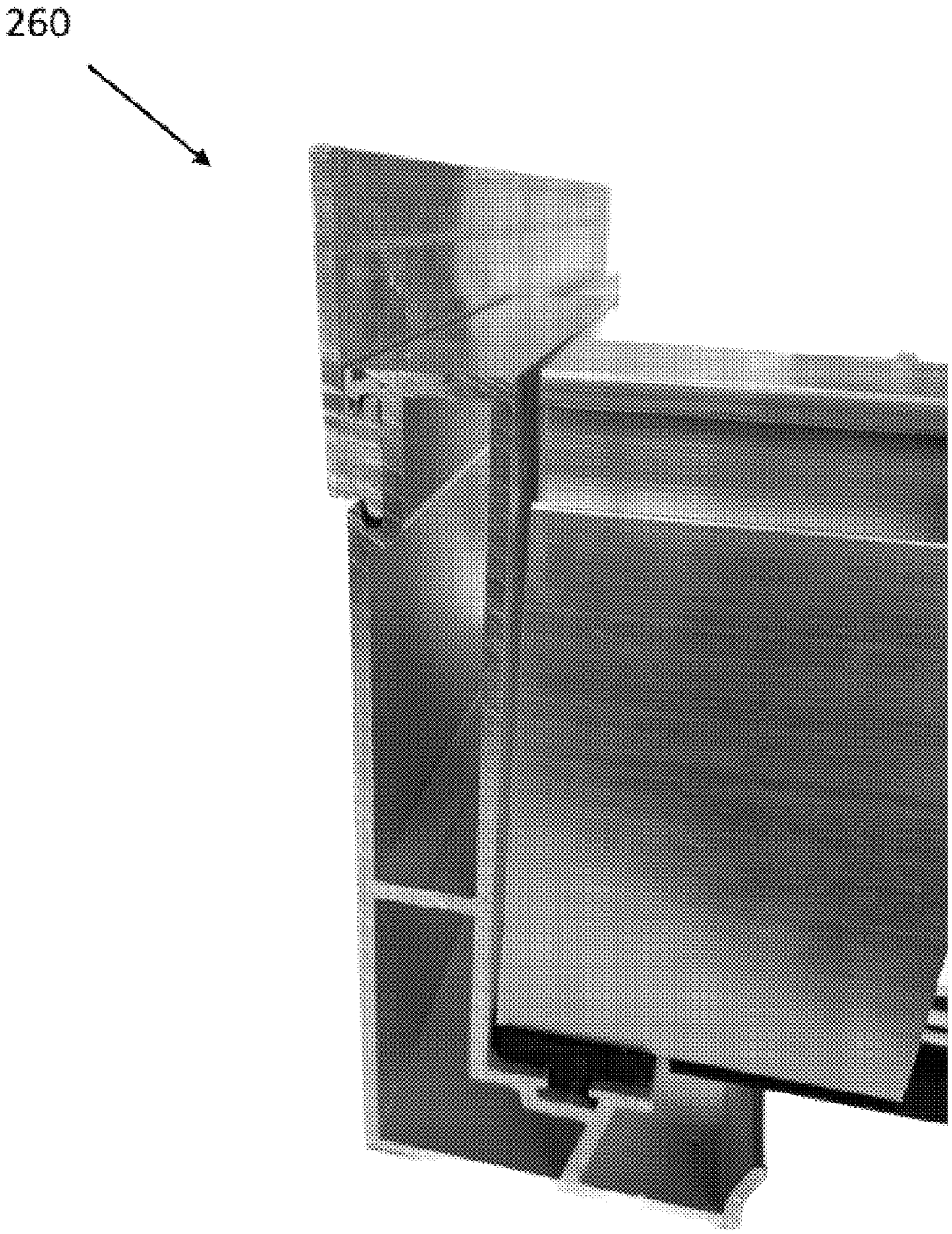
FIG. 21 is showing a method step of securing a soffit to a secondary beam and a mating band of a modular balcony system in accordance with the principles of the present invention.
Figure 22:
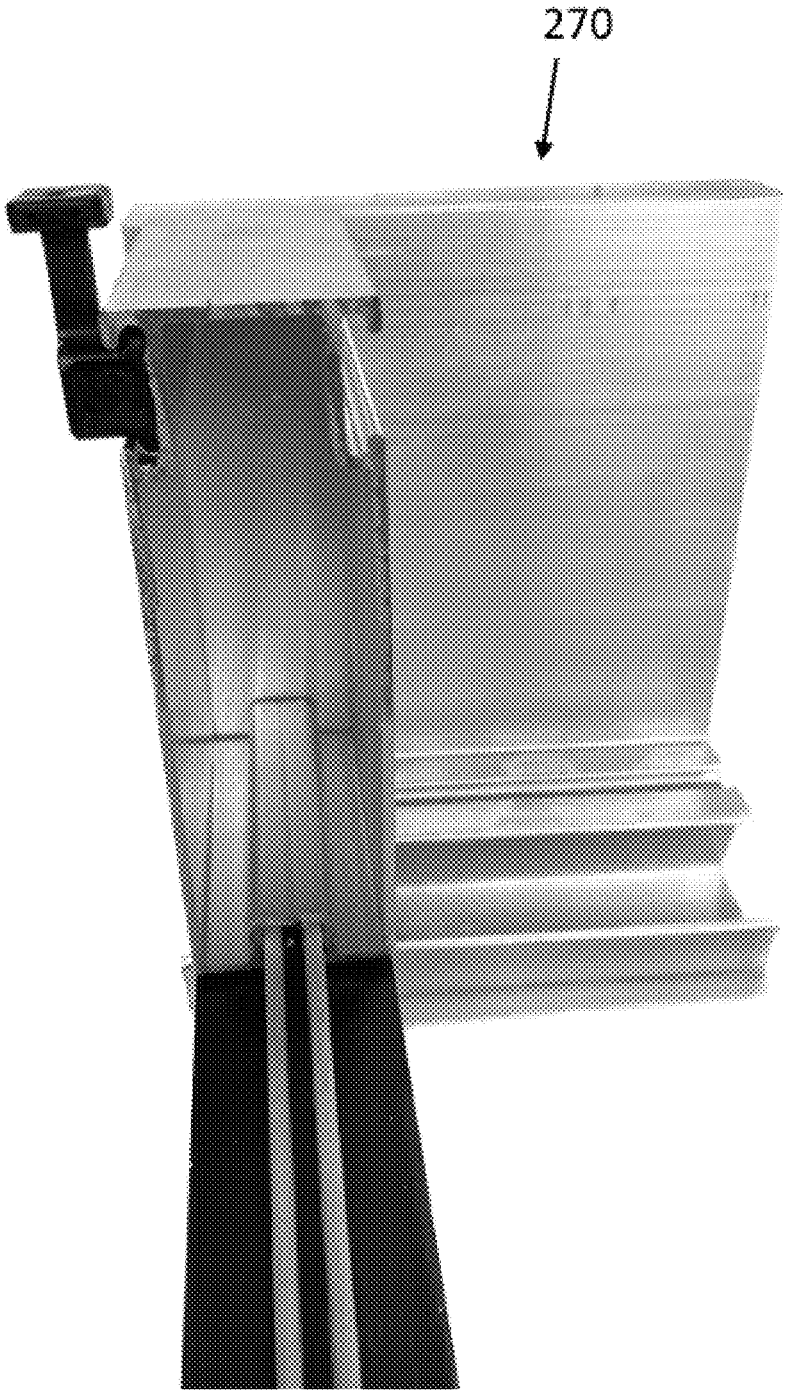
FIG. 22 is showing a method step of installing a support tab to a secondary beam of a modular balcony system in accordance with the principles of the present invention.
Figure 23:
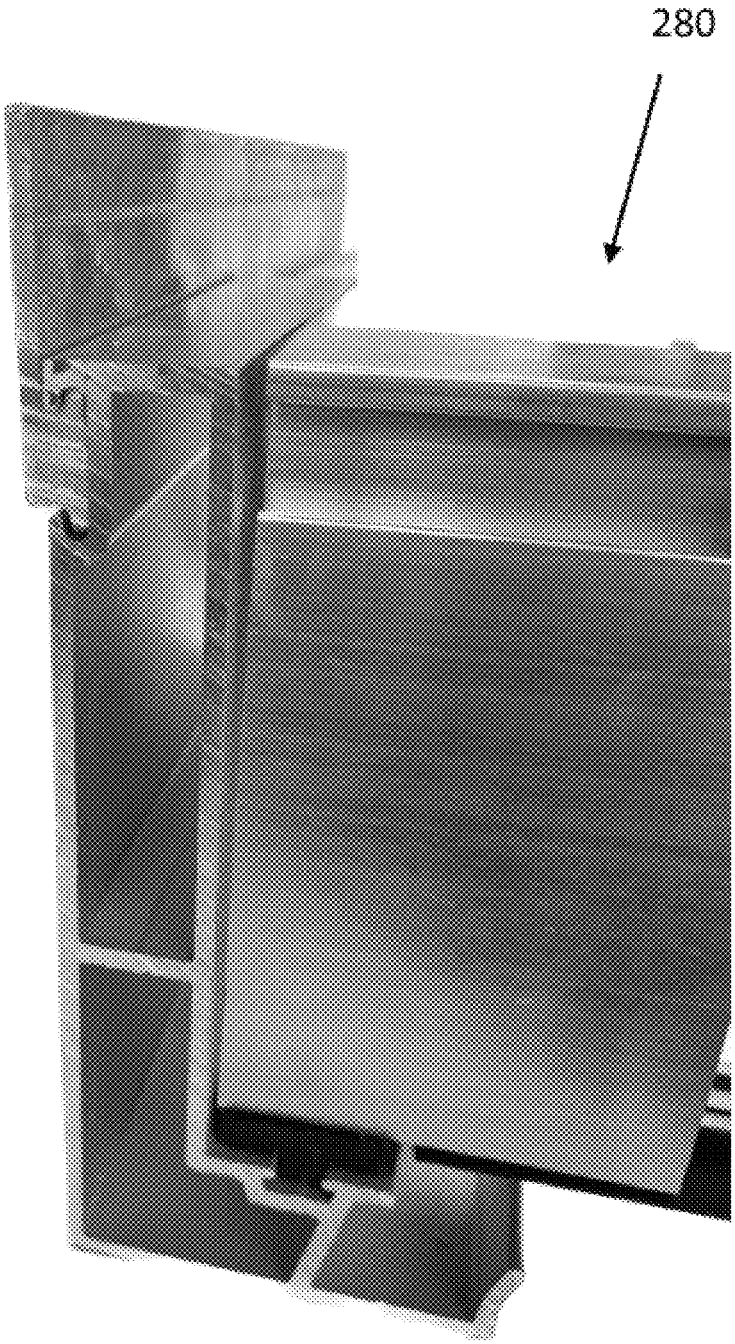
FIG. 23 is showing a method step of installing a contour fascia to a primary beam of a modular balcony system in accordance with the principles of the present invention.

The notches 45, 46 on the sides surfaces 43, 44 of the secondary beam 40 are configured to receive a mating part 48 supporting the floor on top of the balcony system 100. Referring to FIGS. 1, 11, 14 and 15, the mating part 48 may be a support tab. The support tab 48 may have a mating section 49 configured to mate with the notch 45, 46 of the secondary beam 40. Accordingly, the mating section 48 will be shaped in order to be housed within the notch 45, 46 and to slide within the same. The lower part 50 of the mating section 49 may be larger than the higher part 51 to provide more stability and strength to the support tab 48. A first extremity of an elongated joining section 52 may be attached to the mating section 48, the elongated joining section 52 essentially covering the distance between the mating section 49 and the floor to support. At a second extremity of the elongated joining section 52 may be a support section 53. The support section 53 may be a substantially flat section configured to support an area of the floor on the sides of the secondary beam 40. It may be understood that the support tab 48 may have any other shapes known in the art in order to mate with the notch 45, 46 and to support the floor. For example, FIG. 14 and FIG. 15 show two different embodiments of the support tab 48 having different shapes while having the same functions. A side surface 43, 44 of the secondary beam 40 may comprise a plurality of support tabs 48 spaced apart form one another at predetermined lengths. Understandably, the positioning and/or quantity of support tabs 48 on one side of a secondary beam 40 may differ from the other side of the same.

The notch on the bottom surface 42 of the secondary beam 40 is configured to receive a mating part 68 supporting the soffit 60 under the secondary beam 40. Now referring to FIGS. 1 and 11, the soffit 60 has a substantially flat surface and is secured to the bottom of the secondary beams 40. A section 10 of the balcony system 100 may comprise one soffit 60 or may comprise a plurality of soffits 60. The soffit 60 may comprise two alternating surface levels: an elevated surface 62 and a low surface 64. The elevated surfaces 62 and low surfaces 64 may be joined by any means know in the art. For example, the embodied surfaces 62, 64 are secured to one another by substantially perpendicular vertical surfaces 65. In other embodiments not shown, the elevated 62 and low surfaces 64 may be joined to one another by a curved surface. In other embodiments not shown, the soffit 60 may be corrugated and therefore may comprise alternating lower 64 and elevated 62 surfaces having smaller widths than the shown embodiment. In an embodiment, the elevated surface 62 is angled towards the low surface 64 to improve draining and guiding of water towards the lower surface 64.

Figure 12:
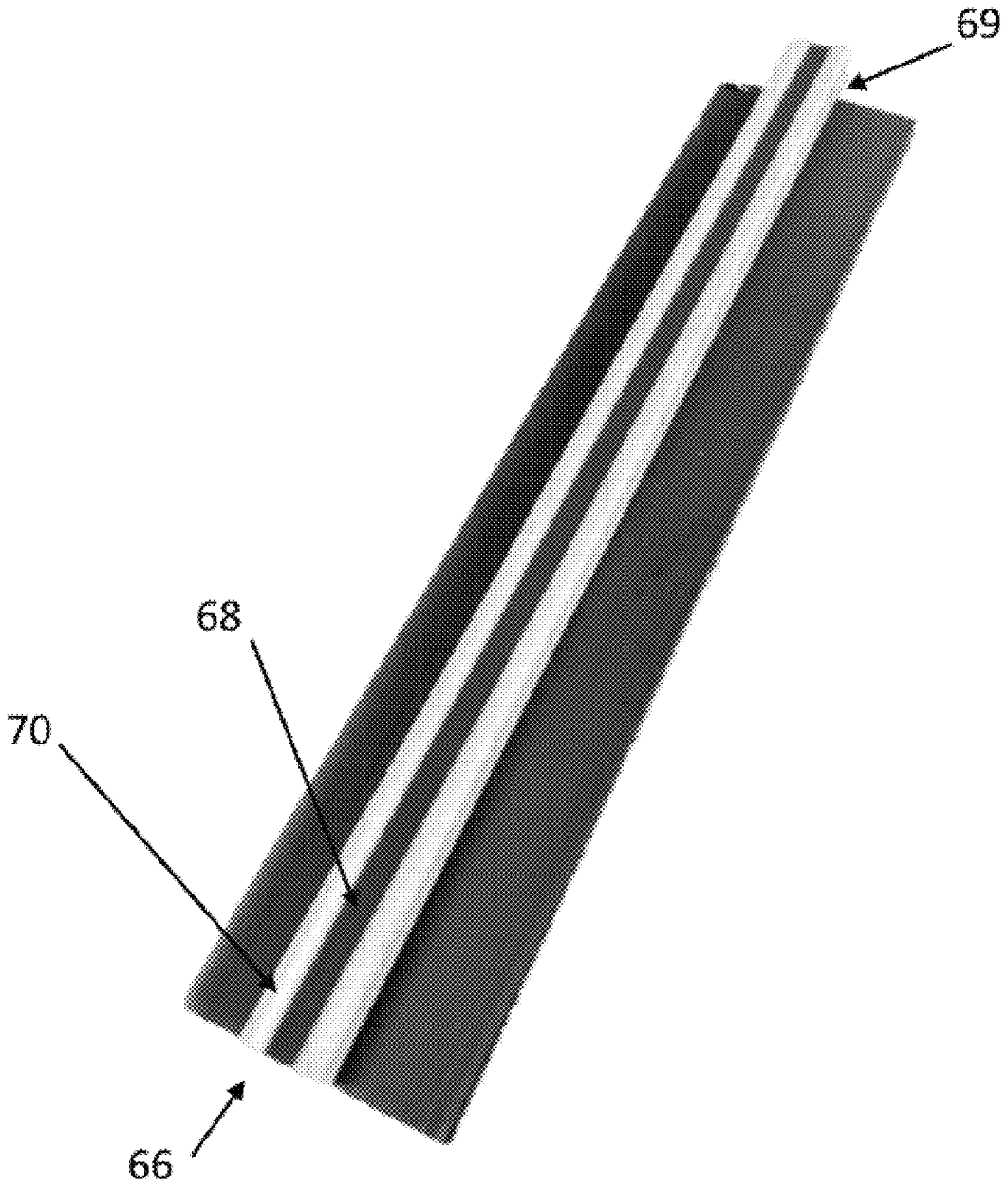
FIG. 12 is a perspective view of a mating band of a modular balcony system in accordance with the principles of the present invention.
Figure 13:
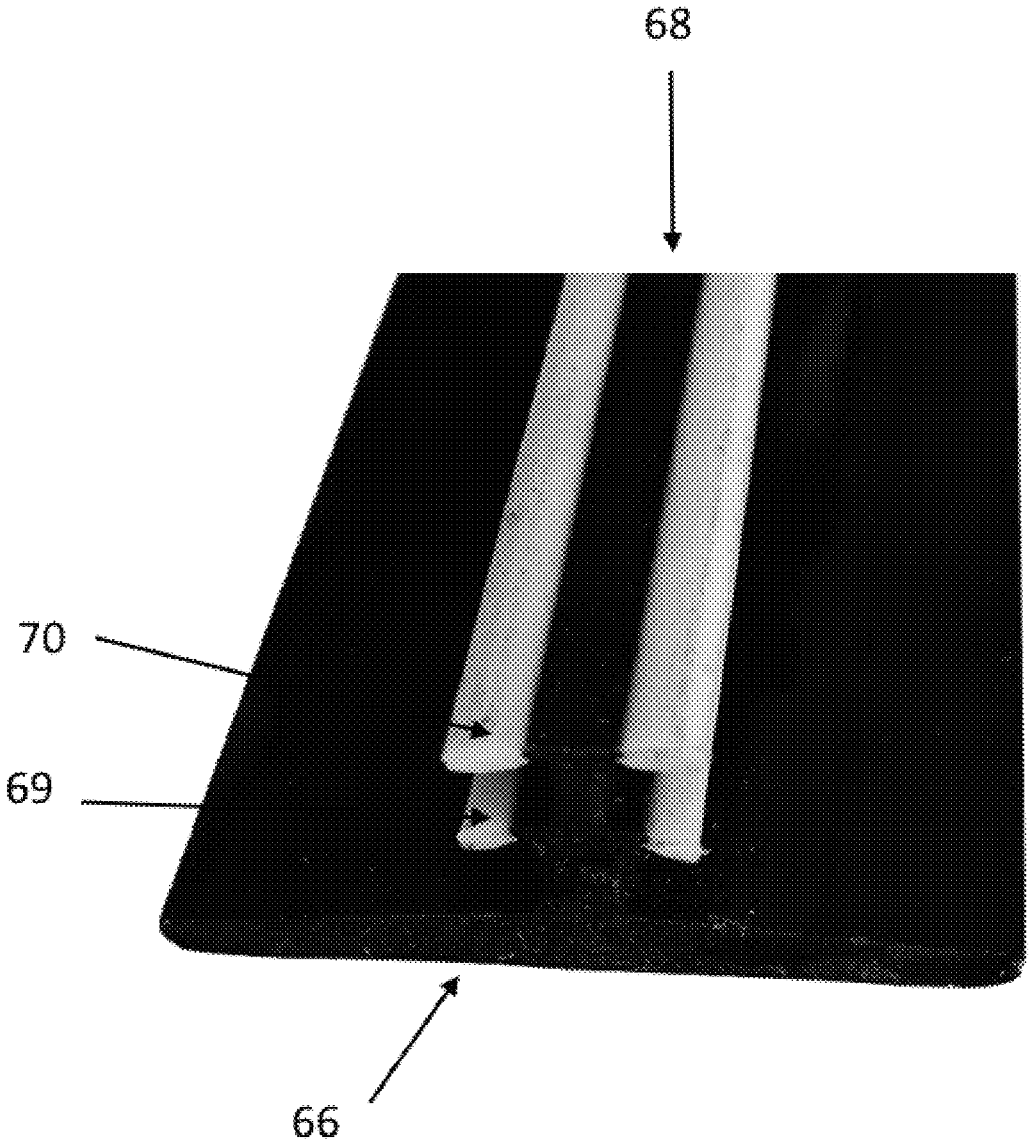
FIG. 13 is a front elevation view of the mating band of FIG. 10.

The elevated surface 62 is generally abutting against the bottom 42 of the secondary beams 40. Along the width of the elevated surface 62 may be a mating band 66, shown in further details in FIGS. 12 and 13. The mating band 66 comprises on its top surface a mating part 68 configured to mate with the bottom notch 47 of the secondary beam 40. The mating part 68 is further configured to slide within the bottom notch 47. The mating part 68 comprises two pairs of dents 69, 70. The dents 69, 70 are configured to slide within the bottom notch 47 of the secondary beam 40 and therefore may each be housed within a level 81 and 82 of the notch 47. The dents 69, 70 may further be made of a semi-flexible material for installing the mating band 66 by pushing the same through the first 81 and/or second level 82 rather than sliding from the side of the secondary beam 40. Accordingly, the dents 69, 70 may be made of any material allowing forced passage of the mating part 68 through the levels 81, 82 while allowing retaining of the elevated surface 62 when no substantially external force is applied. For example, users may fully force the mating part 68 inside the notch 47 by applying force under the mating band 66 with a hammer, mallet or any other similar tool. Other embodiments may comprise other shapes of dents and/or other quantities of dents. In an embodiment, the mating band 66 may be positioned centrally to the width of the elevated surface 62, however it may be positioned anywhere on the elevated surface 62 in other embodiments. In some embodiments, the positioning of the mating bands 66 may be determined based on the positioning of the secondary beams 40 along the length of the main beam 20. In other embodiments, the positioning of the secondary beams 40 may be determined based on the positioning of the mating bands 66.

The low surface 64 may be positioned between two elevated surfaces 62 and may have a lower elevation than the elevated surfaces 62. Accordingly, the low surface 64 may be horizontally positioned in the middle of two secondary beams 40. The low surface 64 is configured to receive fluids and to guide the received fluids towards edges of the soffit 60. In an embodiment of the invention, the low surface 64 may be aligned with regards to the horizontal plan. In yet another embodiment, the low surface 64 may be angled with regards to the horizontal plan, thus facilitating the flow of fluid toward the edges of the soffit 60.

The edge of the soffit 60 may be in contact with the main beam 20, specifically with the gutter 36 of the main beam 20. The edge of the soffit 60 may further be slightly over the gutter 36 of the main beam 20. It may be understood that fluid flowing toward the edges of the soffit 60 may thus fall or flow into the gutter 36 of the main beam 20. Accordingly, fluid falling on the soffit 60 may be directed into the gutter 36 and therefore away from the balcony 100 in a controlled manner. It may thus be appreciated that even if the floor located above the balcony 100 is not entirely waterproof or if humidity is found within the balcony 100, the soffit 60 may protect the surface area under the balcony 100.

In an embodiment of the invention, the parts comprised in the modular balcony 100 are made of a moldable or extrudable material. In a preferred embodiment, the material is aluminum. In other embodiments, the material may be plastic, polymer, polyethylene, or other similar materials. Manufacturing the various parts of the balcony 100 with aluminum, such as the soffit 60 with alternating surfaces having different elevations, provides the ability to manufacture detailed profiles that may not usually be possible with other conventional balcony materials such as steel or wood. It may further be appreciated that some of the parts of the system 100, such as the main beam 20, may either be full or hollow. Accordingly, the weight, quantity of material used and physical characteristics of the system 100 may be altered based on various requirements.

It may be appreciated that the elements of the modular balcony system 100 are secured to one another by sliding mating parts of an element to a notch of another. Thus, no heavy or specialized tooling is required to assemble the modular balcony system 100. It may further be appreciated that the surface area covered by the modular balcony system 100 may be modified by removing or adding sections 10 to already installed sections 10. It may further be appreciated that the balcony system 100, with the materials used and the installation methods used described here below, provides a watertight protection for the area under the balcony system 100.

A method 200 for assembling a modular balcony system is further provided. Some of the steps of the method are shown in FIGS. 16 to 23. The method 200 may comprise the steps of: securing a main beam to external structural elements, sliding a first mating part in a notch of the main beam 210, sliding a second mating part in a notch of the first mating part 220, positioning assemblies of mating parts at a predetermined distance from one another along the main beam, sliding bottom notches of secondary beams into the secondary mating parts 230, sliding a pair of dents of a mating band in a first level of the bottom notch of the secondary beam 240, positioning an elevated surface of a soffit between the bottom surface of the secondary beam and the mating band so that the edges of lower surfaces of the soffit guide fluid towards a gutter of the main beam 250, sliding support tabs in side notches of the secondary beams, applying a force under the mating band and toward the secondary beam to displace the pair of dents of the mating band initially in the first level to the second level whereas a second pair of dent enters the first level 260, securing the elevated surface of the soffit between the bottom surface of the secondary beam and the mating band, and installing a floor over the main beam and secondary beams. The method may further comprise the steps of sliding a mating section of a support tab in a side notch of the secondary beam 270, the support tab being configured to support the floor. The method may further comprise sliding a mating part of a contour fascia in a notch on a side surface of the main beam 280. The method may further comprise sliding another main beam to mating parts under the secondary beams. The method may further comprise securing the main beam of a second section to the main beam of a first section.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A module of a balcony system comprising:

a) a plurality of main beams configured to be located along the entire periphery or part of the periphery of the module, each main beam comprising:
   i) a first vertical surface,
   ii) a second vertical surface substantially opposite to the first surface,
   iii) a first notch in said first surface configured to slidingly receive a mating piece,
   iv) a bottom extremity,
   v) at the bottom extremity, a substantially horizontal section comprising a third surface comprising a second notch configured to slidingly receive a mating part or a plurality thereof configured to allow the main beam to be secured to other elements of the balcony, b) a plurality of secondary beams configured to support a floor surface on top of said secondary beam, each secondary beam comprising a bottom notch that is downwardly-open and configured to be slidingly secured substantially perpendicularly to a main beam via one or more of said mating part and to support a floor surface on top of said secondary beams.

2. A module of a balcony system as claimed in claim 1), wherein the mating piece is a contour fascia configured to cover and protect a portion of a top of the main beam.

3. A module of a balcony system as claimed in claim 2), wherein the contour fascia comprises a mating section for slidingly securing the contour fascia to the first notch.

4. A module of a balcony system as claimed in claim 1), wherein the mating piece is a fastening means for securing the main beam of the module to another main beam of a second module.

5. A module of a balcony system as claimed in claim 1), wherein the horizontal section comprises a gutter forming a guiding path for guiding fluid along the length of the main beam.

6. A module of a balcony system as claimed in claim 1), wherein the main beams and the secondary beams are made of aluminium.

7. A module of a balcony system as claimed in claim 1), wherein each secondary beam bottom notch comprises at least two vertically spaced levels and is configured to receive a mating band with two pairs of dents that are displaced between the levels to clamp an elevated surface of a soffit against the secondary beam.

8. A module of a balcony system as claimed in claim 7), wherein the soffit includes alternating elevated and low surfaces whose edges overlie a gutter formed in the main beam to guide fluid away.

9. A method for assembling a modular balcony system comprising the following steps:

a) securing a main beam to external structural elements, b) sliding a first mating part in a notch located in a lower portion of the main beam, c) positioning assemblies each comprising a secondary beam and a second mating part at a predetermined distance from one another along the main beam, d) sliding the second mating part in a notch of the first mating part, and c) installing a floor over the main beam and secondary beams.

10. A method for assembling a modular balcony system as claimed in claim 9), further comprising the step of further sliding a mating section of a support tab into a side notch of one of the secondary beams, the support tab being configured to support the floor.

11. A method for assembling a modular balcony system as claimed in claim 9), further comprising the step of sliding a mating part of a contour fascia in a notch on a side surface of the main beam.

12. A method for assembling a modular balcony system as claimed in claim 9), further comprising the step of sliding another main beam to mating parts under the secondary beams.

13. A method for assembling a modular balcony system as claimed in claim 9), further comprising the step of securing a main beam of a second section, the second section comprising a second main beam secured to the main beam of the first section.

14. A method for assembling a modular balcony system as claimed in claim 9), further comprising the steps of:

f) sliding a pair of dents of a mating band in a first level of a bottom notch of one of the secondary beam, g) positioning an elevated surface of a soffit between a bottom surface of the secondary beam and the mating band so that the edges of lower surfaces of the soffit guide fluid towards a gutter of the main beam, h) sliding support tabs in side notches of the secondary beams, i) applying a force under the mating band and toward the secondary beam to displace the pair of dents of the mating band initially from a first level to a second level of the bottom notch of one of the secondary beams whereas a second pair of dents enters the first level, and j) securing the elevated surface of the soffit between the bottom surface of the secondary beam and the mating band.

* * * * *